US006718881B2

(12) United States Patent
Rauscher, Jr.

(10) Patent No.: US 6,718,881 B2
(45) Date of Patent: Apr. 13, 2004

(54) ORDNANCE CONTROL AND INITIATION SYSTEM AND RELATED METHOD

(75) Inventor: Robert A. Rauscher, Jr., Moorestown, NJ (US)

(73) Assignee: Alliant Techsystems Inc., Edina, MN (US)

( * ) Notice: Subject to any disclaimer, the term of this patent is extended or adjusted under 35 U.S.C. 154(b) by 0 days.

(21) Appl. No.: 09/949,031

(22) Filed: Sep. 7, 2001

(65) Prior Publication Data

US 2003/0159609 A1 Aug. 28, 2003

(51) Int. Cl.[7] ..... F42C 15/42
(52) U.S. Cl. ..... 102/217; 102/201; 102/218
(58) Field of Search ..... 102/217, 201, 102/218, 220

(56) References Cited

U.S. PATENT DOCUMENTS

| | | | | |
|---|---|---|---|---|
| 4,391,195 A | | 7/1983 | Shann | |
| 4,599,745 A | | 7/1986 | Baran et al. | |
| 4,678,905 A | | 7/1987 | Phillips | |
| 4,862,802 A | | 9/1989 | Streifer et al. | |
| 4,870,902 A | | 10/1989 | Simon et al. | |
| 4,903,602 A | * | 2/1990 | Skagerlund | 102/213 |
| 5,138,946 A | | 8/1992 | Soltz et al. | |
| 5,204,490 A | | 4/1993 | Soltz et al. | |
| 5,206,455 A | * | 4/1993 | Williams et al. | 102/201 |
| 5,229,538 A | * | 7/1993 | McGlynn et al. | 89/1.56 |
| 5,317,973 A | * | 6/1994 | Winaver | 102/201 |
| 5,322,019 A | * | 6/1994 | Hyland | 102/312 |
| 5,404,820 A | * | 4/1995 | Hendrix | 102/201 |
| 5,460,093 A | | 10/1995 | Prinz et al. | |
| 5,473,623 A | | 12/1995 | Fahey et al. | |
| 6,199,483 B1 | * | 3/2001 | Barbiche | 102/201 |

FOREIGN PATENT DOCUMENTS

| | | | | |
|---|---|---|---|---|
| DE | 33 22 990 A1 | * | 1/1985 | 102/201 |
| GB | 2 063 964 | * | 6/1981 | 102/201 |
| JP | 61-205799 | * | 9/1986 | 102/201 |
| WO | WO 8807170 | * | 9/1988 | 102/201 |

* cited by examiner

*Primary Examiner*—Stephen M. Johnson
(74) *Attorney, Agent, or Firm*—TraskBritt

(57) ABSTRACT

An ordnance control and initiation system is provided. The system includes a plurality of ordnance devices which may be segregated into a plurality of sets. Each set of the ordnance devices has at least one ordnance device and further includes an ordnance device interface, which preferably includes an optical-to-electrical converter. A controller issues state commands to a master ignition control module operatively coupled to the controller, which retransmits the state commands to a plurality of slave ignition control modules. Each of the slave ignition control modules associated with one of the sets of the ordnance devices and preferably is optically coupled to each of the ordnance devices within that set. The slave ignition control modules re-transmit the state commands optically to the ordnance devices of the associated the ordnance device set of that slave ignition control module. A capacitive device may be used at the optical-to-electrical converter to store the electrical energy received through the state signal and to selectively discharge that energy into an initiator at the ordnance device to initiate the device. Related devices and methods are disclosed as well.

52 Claims, 4 Drawing Sheets

ORDNANCE CONTROL AND INITIATION SYSTEM AND RELATED METHOD

BACKGROUND OF THE INVENTION

1. Field of the Invention

The present invention relates to an ordnance control and initiation systems and methods useful for managing and controlling the activation of ordnance, for example, such as those used for stage separation in flight vehicles. The system and method, for example, may relate not only to ordnance safing, arming and initiation, but monitoring and telemetry acquisition as well.

2. Description of the Related Art

There are numerous applications in which it is necessary or desirable to control and/or initiate ordnance with high precision and reliability. One such application, although merely illustrative and not by way of limitation, involves the ordnance associated with rockets, missiles, and similar powered flight vehicles (hereinafter "flight vehicles"). It is not uncommon for such vehicles to include a plurality of ordnance devices for performing interrelated or distinct tasks. By way of example, a flight vehicle may contain multiple stages, with each stage having its own distinct ordnance in the form of a gas generant or propellant. In some instances, a flight vehicle stage may have multiple gas generants or propellants, such as found in the case of rocket motor stages having main and divert motors. Each of these gas generants and propellants typically has its own distinct initiator for activating (directly or by an ignition train) the gas generant and propellant.

Another illustrative use of ordnance devices in multi-stage flight vehicles involves stage separation. As a lower stage is depleted of gas generant or propellant, the depleted lower stage must be separated from the remaining upper stage or stages before the next stage can be fired. This stage separation is typically performed with ordnance devices, each of which must be activated with precise timing for successful stage separation.

Another example of the use of ordnance devices on a flight vehicle, especially a multi-stage flight vehicle, can be found at the uppermost or "kill" stage of a missile. The kill stage often has a first ordnance device in the form of a gas generant or propellant for propelling the kill stage, and a second ordnance device in the form of an explosive for imparting maximum damage to its intended target.

Further examples of ordnance device applications on flight vehicles include the use of solid or liquid fuel ordnances on launch vehicles for propelling devices, such as satellites, into space. As yet another example, a flight vehicle may contain destruct (explosive) ordnances for destroying the vehicle or its cargo or payload in the event of a malfunction or error in launch trajectory or flight control.

The ordnance devices of flight vehicles require an ignition event for activation of the ordnance device or initiation of an ignition train that results in activation of the ordnance device. Typically, each ordnance device of a flight vehicle is associated with its own initiator. The initiator typically includes a squib having a bridge wire and pyrotechnic material. A pyrotechnic reaction is initiated by sending electrical energy to the squib, which converts the electrical energy to thermal energy until the bridge wire reaches a sufficiently high temperature to ignite the pyrotechnic material of the squib. The pyrotechnic material then either ignites the propellant/gas generant directly or ignites an ignition train that leads to the ignition of the propellant/gas generant.

Known electrical ignition systems have several drawbacks. Perhaps the most significant one is the possibility of unintentional activation of the ordnance, e.g., caused by unwanted and unplanned electromagnetic energy or fields, such as electromagnetic interference, lightning, electrostatic discharge, etc. This drawback in some cases and to some extent may be mitigated by heavily shielding the electrical system to shield it against such external electrical phenomena. However, shielding of the electrical system adds production costs and makes testing and installation difficult. It also adds to system mass.

Another drawback of some known electrical ordnance systems is their requirement for sometimes lengthy and relatively heavy conductor cabling, such as twisted pair cabling, and the associated shielding and harnesses. Such systems can be disadvantageous, for example, based on their relatively high mass penalties, relatively substantial installation requirements, and high rework difficulty. Electrical conductors also can be subject to relatively substantial power losses when they run for significant distances. Large, heavy pyrotechnic controller black boxes often are required to interface commands from the command computer to the ordnance devices.

It is often desirable in ordnance applications to have the flexibility to scale the system, for example, by adding additional ordnance devices. When this is done with many known systems, it typically requires additional control circuits and cabling. As a consequence, for example, it is often not feasible or unduly difficult or penalizing to integrate a telemetry system with the ordnance system. In such cases it is often necessary for the transmission lines and controllers of the telemetry and ordnance systems to remain discrete from each other.

Another approach, often used as an alternative to the electrical activation system, involves the use of electro-optics. In such systems, for example, electrical control and/or initiation signals are converted into optical signals and transmitted via optical signal conduits, such as a fiber optic cable. The optical energy is used to transmit power and optionally commands through an optical fiber system to the squib. Such systems, however, also may have drawbacks. For one, the power transmission capacity of optical conduits typically is relatively limited. Moreover, optical transmission can be subject to substantial energy loss over long distances, particular at relatively high power levels. For this reason, optical initiation systems are often are not suitable for large vehicles having lengthy optical conduits. optical transmission. Another drawback in some electro-optic systems involves the potentially substantial amount of cabling or optical conduit runs to couple the controller to the ordnance devices.

OBJECTS OF THE INVENTION

Accordingly, an object of the present invention is an ordnance control and initiation system and method that are reliable relative to known systems and methods, and thus which limit or preclude inadvertent ignition of the ordnance.

It is another object of the invention to provide an ordnance control and initiation system and method that can have lower overall mass relative to known systems and methods having like overall functional capability.

It is also an object of the invention to provide an ordnance control and initiation system and method that offer the flexibility to be scalable.

Additional objects and advantages of the invention will be set forth in the description which follows, and in part will be apparent from the description, or may be learned by practice of the invention. The objects and advantages of the invention may be realized and obtained by means of the instrumentalities and combinations pointed out in the appended claims.

SUMMARY OF THE INVENTION

To achieve the foregoing objects, and in accordance with the purposes of the invention as embodied and broadly described in this document, an ordnance control and initiation system is provided. It comprises a plurality of ordnance devices comprising a plurality of sets of the ordnance devices. Each set of the ordnance devices comprises at least one of the ordnance devices and an ordnance device interface. The system also comprises a controller for issuing state commands, a master ignition control module operatively coupled to the controller to receive the state commands and re-transmit the state commands, and a plurality of slave ignition control modules. Each of the slave ignition control modules is associated with one of the sets of the ordnance devices and is operatively coupled to the master ignition control module and optically coupled to the ordnance device interface of the one of the ordnance device sets of that slave ignition control module. Each of the slave ignition control modules receives the state commands and retransmits the state commands to the ordnance devices of the one of the ordnance device sets of that slave ignition control module.

Preferably, the ordnance device interface of one of the ordnance device sets comprises an optical-to-electrical converter. Each of the ordnance devices of the one of the ordnance device sets preferably comprises a capacitor device operatively coupled to the optical-to-electrical converter so that the capacitor device is charged when light from the slave ignition control module corresponding to that ordnance device set impinges upon the optical to electrical converter. In the presently preferred embodiments, each of the ordnance devices comprises an initiator operatively coupled to the capacitor to receive electrical energy from the capacitor when the capacitor is discharged. Preferably, one of the ordnance device sets comprises a plurality of the ordnance devices, each of the ordnance devices of the one ordnance device set comprises an initiator, and the ordnance device interface of the one of the ordnance device sets comprises a plurality of optical-to-electrical converters corresponding in number to the number of ordnance devices of the one ordnance device set, wherein each of the ordnance devices of the one of the ordnance device sets has an associated one of the optical-to-electrical converters. Also preferably, each of the ordnance devices of the one of the ordnance device sets comprises a capacitor device operatively coupled to the associated optical-to-electrical converter so that the capacitor device is charged when light from the slave ignition control module corresponding to that ordnance device impinges upon the associated optical-to-electrical converter.

The ordnance devices may comprise, for example, a semiconductor bridge initiator, e.g., comprising titanium subhydride potassium perchlorate, a thin film bridge initiator, or the like.

The state commands may comprise a safe command, an arm command, and a fire command. Optionally but preferably in some application, state commands may comprise a power signal, in which the signal of whatever information content may be used as a source of energy or power also to cause or aid in the initiation of the ordnance device. The state commands comprise an ordnance device address for addressing individual ones of the ordnance device sets, individual ones of the ordnance devices within one of the ordnance device sets, and/or individual ones of the ordnance devices.

The master ignition module preferably is optically coupled to the slave ignition control modules, but may be coupled, for example, electrically.

The system optionally but preferably further includes a monitoring device optically coupled to one of the slave ignition control modules for generating an upstream signal. In this instance, the one of the slave control modules comprises a transmitting device for re-transmitting the upstream signal to the master ignition control module and the master control module comprises a transmitting device for re-transmitting the upstream signal to the controller.

In accordance with another aspect of the invention, an ordnance control and initiation system is provided which comprises a plurality of ordnance devices comprising a first and a second plurality of sets of the ordnance devices. Each set of the ordnance devices comprises at least one of the ordnance devices and an ordnance device interface. The system also comprises a controller for issuing state commands, first and second master ignition control modules operatively coupled to the controller to receive the state commands and re-transmit the state commands, a first and a second plurality of slave ignition control modules, wherein each of the slave ignition control modules of the first plurality of slave ignition control modules is associated with one of the first plurality of sets of the ordnance devices and each of the slave ignition control modules of the second plurality of slave ignition control modules is associated with one of the second plurality of sets of the ordnance devices. Each of the slave ignition control modules is operatively coupled to the master ignition control module and optically coupled to the ordnance device interface of the one of the ordnance device sets of that slave ignition control module, each of the slave ignition control modules receives the state commands and re-transmits the state commands to the ordnance devices of the one of the ordnance device sets of that slave ignition control module.

This aspect of the invention makes clear that the system may be used, for example, to provide multiple channels or paths so that the system has backup and redundancy. Illustrative examples of such redundant systems are provided below in the preferred embodiments.

In accordance with another aspect of the invention, an ordnance control and initiation system is provided for controlling and initiating a plurality of ordnance devices comprising a plurality of sets of the ordnance devices, wherein each set of the ordnance devices comprises at least one of the ordnance devices. The system comprises a plurality of ordnance device interfaces corresponding in number to the number of ordnance device sets, wherein each of the ordnance device interfaces has a corresponding one of the ordnance device sets. The system also comprises a controller for issuing state commands, a master ignition control module operatively coupled to the controller to receive the state commands and re-transmit the state commands, and a plurality of slave ignition control modules. Each of the slave ignition control modules is associated with one of the sets of the ordnance devices and is operatively coupled to the master ignition control module and optically coupled to the ordnance device interface of the one of the ordnance device sets of that slave ignition control module. Each of the slave ignition control modules receives the state commands and re-transmits the state commands to the ordnance devices of the one of the ordnance device sets of that slave ignition control module.

Preferably, the ordnance device interface corresponding to one of the ordnance device sets comprises an optical-to-electrical converter. It is also preferred that each of the ordnance device interfaces comprises a capacitor device operatively coupled to the optical-to-electrical converter so that the capacitor device is charged when light from the slave ignition control module corresponding to that ordnance device set impinges upon the optical to electrical converter. Each of the ordnance devices also preferably comprises an initiator and the capacitor includes coupling means for coupling the capacitor to the initiator so that the capacitor discharges into the initiator. Preferably, for example, one of the ordnance device sets comprises a plurality of the ordnance devices, each of the ordnance devices of the one ordnance device set comprises an initiator, and the ordnance device interface corresponding to the one of the ordnance device sets comprises a plurality of optical-to-electrical converters corresponding in number to the number of ordnance devices of the one ordnance device set, wherein each of the optical-to-electrical converters is associated with one of the ordnance devices of the one of the ordnance device sets. In accordance with another preferred aspect, each of the ordnance device interfaces comprises a capacitor device operatively coupled to the associated optical-to-electrical converter so that the capacitor device is charged when light from the slave ignition control module corresponding to that ordnance device impinges upon the associated optical-to-electrical converter. Other preferred aspects of this system are as described above. In accordance with another aspect of this invention, an ordnance control and initiation system is provided for controlling and initiating a plurality of ordnance devices comprising a first and a second plurality of sets of the ordnance devices. Each set of the ordnance devices comprises at least one of the ordnance devices. The system comprises a plurality of ordnance device interfaces corresponding in number to the number of ordnance device sets, wherein each of the ordnance device interfaces has a corresponding one of the ordnance device sets. The system also comprises a controller for issuing state commands, first and second master ignition control modules operatively coupled to the controller to receive the state commands and re-transmit the state commands, and a first and a second plurality of slave ignition control modules. Each of the slave ignition control modules of the first plurality of slave ignition control modules is associated with one of the first plurality of sets of the ordnance devices and each of the slave ignition control modules of the second plurality of slave ignition control modules is associated with one of the second plurality of sets of the ordnance devices. Each of the slave ignition control modules is operatively coupled to the master ignition control module and optically coupled to the ordnance device interface of the one of the ordnance device sets of that slave ignition control module. Each of the slave ignition control modules receives the state commands and re-transmits the state commands to the ordnance devices of the one of the ordnance device sets of that slave ignition control module.

In accordance with yet another aspect of the invention, a method for controlling and selectively initiating ordnance devices. The method comprises communicating state commands from a controller to a master ignition control module operatively coupled to the controller, communicating the state commands from the master ignition control module to a plurality of slave ignition control modules operatively coupled to the master ignition control module, wherein each of the slave ignition control modules is associated with one of a plurality of sets of ordnance devices and is optically coupled to an ordnance device interface of the one of the ordnance device sets of that slave ignition control module, and communicating the state commands from each of the slave ignition control modules to the ordnance devices of the one of the ordnance device sets of that slave ignition control module. Preferably, the communication from the slave ignition control modules to the ordnance devices comprises performing an optical-to-electrical conversion of the state commands. It is also preferable that the optical-to-electrical conversion comprises charging a capacitor device and selectively discharging the capacitor device into an initiator for each of the ordnance devices. The state commands may comprise a safe command, an arm command, and a fire command. The state commands also may comprise a power signal, as described above. The state commands also may comprise an ordnance device address for addressing individual ones of the ordnance device sets, an ordnance device address for addressing individual ones of the ordnance devices within one of the ordnance device sets, and/or an ordnance device address for addressing individual ones of the ordnance devices.

Communication of the state from of the state commands from the master ignition module to the slave ignition control modules optionally but preferably is optical, but also may be electrical, for example. The method also optionally but preferably comprises optically communicating an upstream signal from a monitoring device optically coupled to one of the slave ignition control modules to the one of the slave control modules, communicating the upstream signal from the one of the slave ignition control modules to the master ignition control module, and communicating the upstream signal from the master ignition control signal to a controller.

BRIEF DESCRIPTION OF THE DRAWINGS

The accompanying drawings, which are incorporated in and constitute a part of the specification, illustrate presently preferred embodiments and methods of the invention and, together with the general description given above and the detailed description of the preferred embodiments and methods given below, serve to explain the principles of the invention. Of the drawings.

DETAILED DESCRIPTION OF THE PREFERRED EMBODIMENTS AND METHODS

Figure 1:
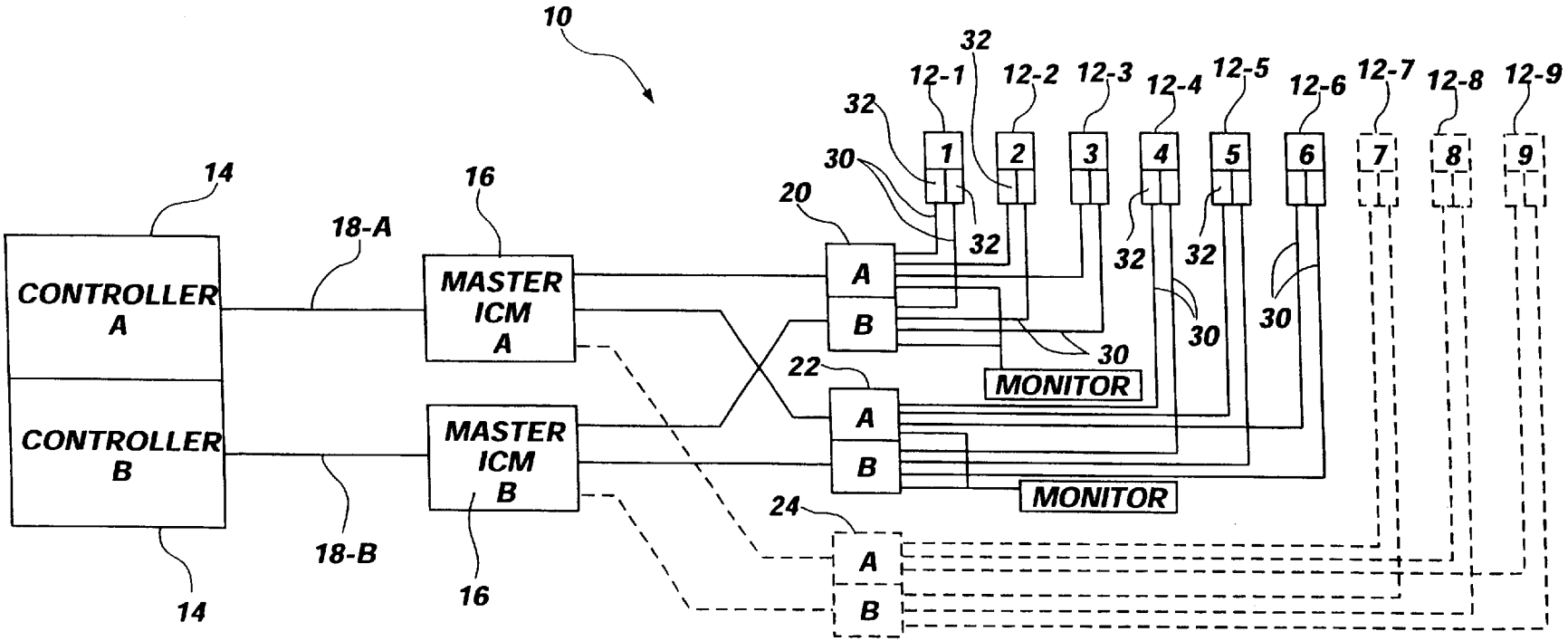
FIG. 1 is a schematic diagram of an ordnance control and initiation system in accordance with a first presently preferred embodiment of the invention.

Reference will now be made in detail to the presently preferred embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in this section in connection with the preferred embodiments and methods. The invention according to its various aspects is particularly pointed out and distinctly claimed in the attached claims read in view of this specification, and appropriate equivalents.

It is to be noted that, as used in the specification and the appended claims, the singular forms "a," "an," and "the" include plural referents unless the context clearly dictates otherwise.

Figure 2:
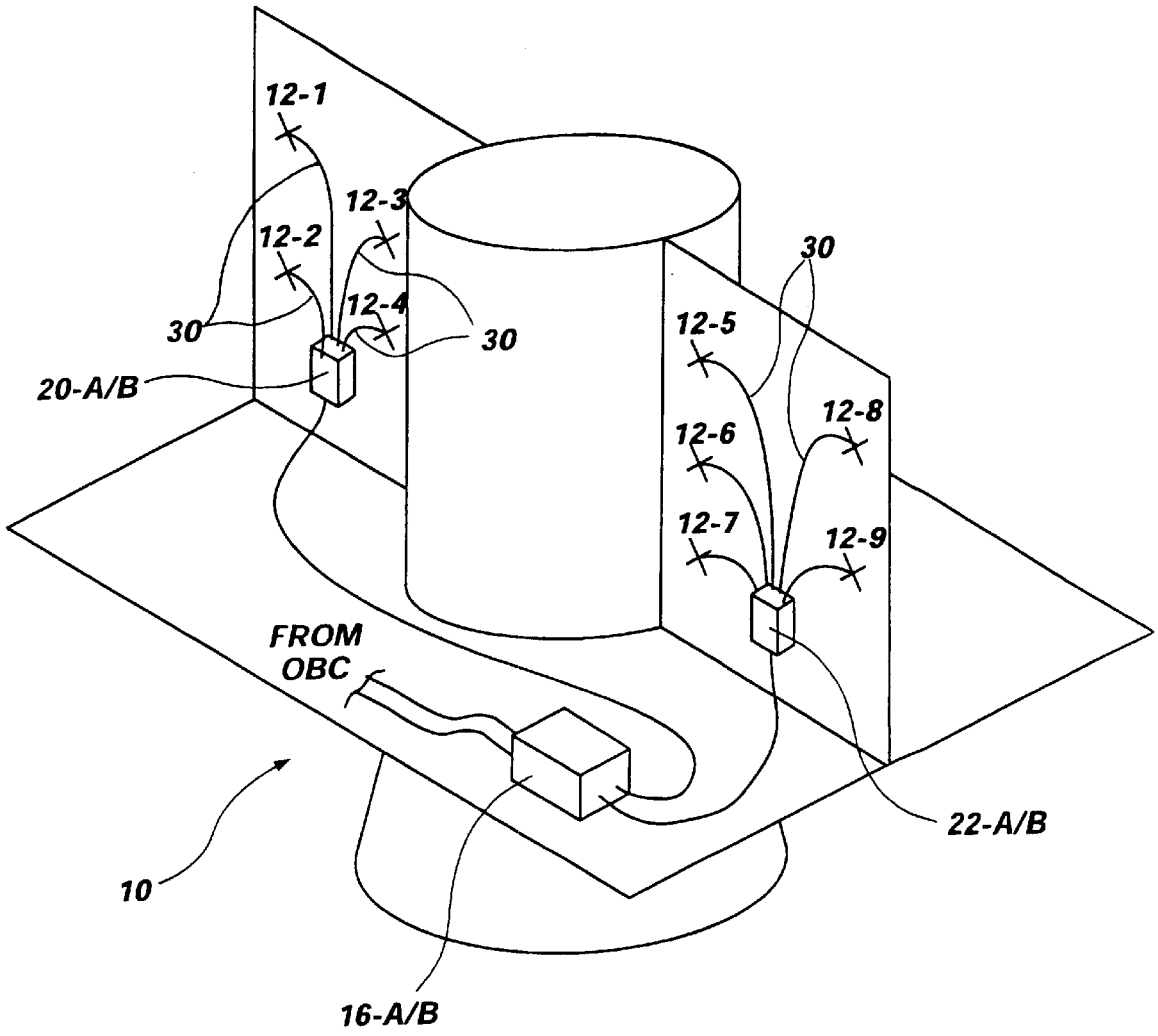
FIG. 2 is a perspective view of an illustrative version of the system shown in FIG. 1.
Figure 3:
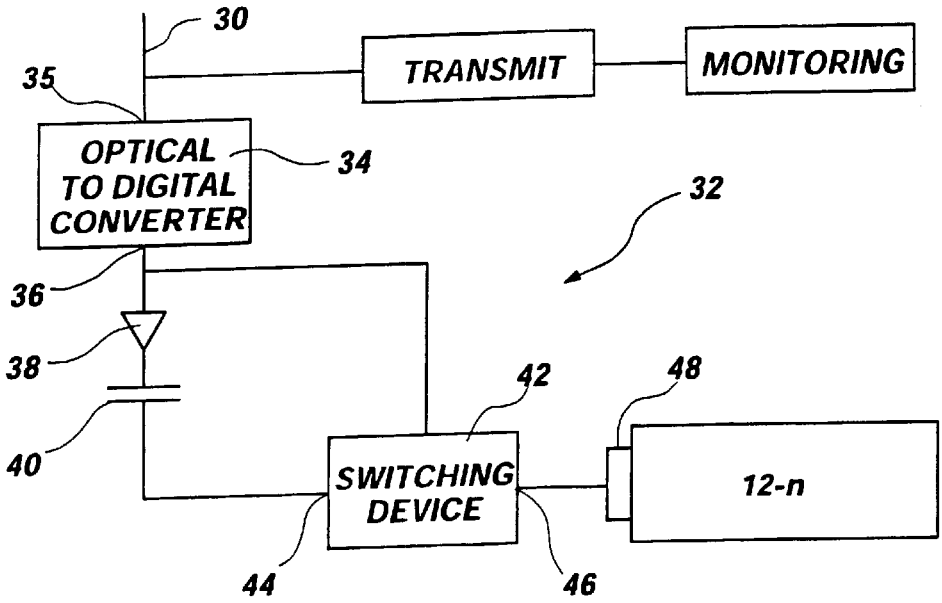
FIG. 3 is a schematic diagram of an ordnance device interface for the system of FIG. 1.

In accordance with one aspect of the invention, an ordnance control and initiation system is provided. To illustrate this aspect of the invention, but not by way of limitation, a system 10 according to a first presently preferred embodiment of the invention is shown in FIG. 1. In this illustrative example, an ordnance and control system is provided for use in a flight vehicle, such as the stage separation mechanism for a multi-stage solid rocket (not shown). FIG. 2 provides a perspective view of system 10 applied to a demonstration or mockup arrangement, as will be described in further detail below.

The system according to this aspect of the invention comprises a plurality of ordnance devices. These ordnance devices may be of a variety of types, designs, shapes, sizes, etc. The specific types of ordnance device or devices used in accordance with the invention are generally not limiting. In general, however, such devices would be expected to include some form of initiator. Preferred examples of such initiators are solid-state initiators, and more specifically, e.g., semiconductor bridge or thin film bridge initiators.

In accordance with the presently preferred embodiment, system 10 comprises ordnance devices 12-1, 12-2, 12-3, . . . which in this illustrative system comprise ordnance as are known for use in solid rocket stage separation arts, and having semiconductor bridge initiators in the form of Semiconductor Bridge Squibs, commercially available from Alliant Tactical Systems Co. of Elkton, Md. ("Alliant"). These ordnance devices are disposed in known manner to effect the separation of the motor stages at the appropriate time and in the appropriate manner as is known in the art.

The ordnance devices preferably are segregated into a plurality of sets wherein each set of the ordnance devices comprises at least one of the ordnance devices. Each of the ordnance devices 12 comprises an ordnance device interface, as will be described in greater detail below.

The system according to this aspect of the invention also comprises a controller for issuing state commands. The controller performs the function of issuing "state" command regarding the state of the ordnance devices. The state commands preferably include a "safe" command which causes the ordnance devices to be inactivated or placed in a "safe" condition, an "arm" command which causes the ordnance devices under appropriate circumstances to arm, and a "fire" command which under appropriate circumstances causes the ordnance devices to be initiated. The state command may comprise a single command to be issued to all ordnance devices simultaneously or essentially simultaneously, it may designate or include addressing for individual ones or individual sets or groups of the ordnance devices, etc. The controller may perform other functions, in addition to these, or in addition to the issuance of state commands. The controller, for example, may comprise an overall system controller, such as the "command and data handling" ("C&DH") system for the flight vehicle. Similarly, the controller from a hardware perspective may take a number of forms, including a microprocessor, a general purpose computer, an embedded microprocessor, a custom integrated circuit, and the like. In the illustrative system 10, the controller comprises one, and preferably two on-board computers or C&DH systems 14-A and 14-B. Two such computers are provided in this application for redundancy and reliability.

Further in accordance with this aspect of the invention, the system comprises a master ignition control module operatively coupled to the controller to receive the state commands and re-transmit the state commands. The master ignition control module ("master ICM") may be of known design, and such modules suitable for various applications within the scope of the invention are commercially available from a number of sources. As implemented in illustrative system 10, the master ICM comprises one, and preferably two master ICM units 16-A and 16-B. Master ICMs 16-A and 16-B are operatively coupled to one another via electrical conduits 18-A and 18-B of known design. This is not, however, limiting. Controller 14 (or its individual units 14-A and 14-B) may be coupled to master ICM 16 (or individual units 16-A and 16-B) by optical conduit means, for example, such as a fiber optic cabling, light guides, and the like. The output of controller 14 (14-A and 14-B) normally will be in electrical form, and typically in digital form. If optical communication is used between controller 14 and master ICM 16, controller 14 typically will require an appropriate electrical-to-optical converter, as are known in the art and commercially available. Master ICM typically are microprocessor based and under software control. Accordingly, appropriate optical-to-electrical conversion means, such as known and commercially available optical-to-electrical converters, will be required.

Further in accordance with this aspect of the invention, the system comprises a plurality of slave ignition control modules ("slave ICM"), each of which may comprise an ignition control module of known design, examples of which are commercially available. Slave ICMs typically, although not necessarily, will be microprocessor based and under the control of software. In system 10, the slave ICMs take the form of slave ICMs 20-A and 20B, 22-A and 22-B, 24-A and 22-B, and so on. Slave ICMs 24-A and 24-B are shown in phantom to illustrate the point that the system is scalable. Additional ordnance devices, e.g., 12-7, 12-8, and 12-9, may be added to and managed by the system, or the system may segregate the existing ordnance devices in a variety of ways, by adding additional slave ICMs or sets of slave ICMs.

Each of the slave ICMs is associated with one of the sets of the ordnance devices and is operatively coupled to the master ignition control module and optically coupled to the ordnance device interface of the one of the ordnance device sets of that slave ignition control module. In system 10, slave ICMs 20-A and 20-B are coupled redundantly control and manage ordnance devices 12-1 through 12-3 ("set 1"), slave ICMs 22-A and 22-B redundantly control and manage ordnance devices 12-4 through 12-6 ("set 2"), and slave ICMs 24-A and 24-B redundantly control and manage ordnance devices 12-7 through 2-9 ("set 3"). Each of the slave ICMs is optically coupled to the ordnance devices with which it is associated by optical conduit means, such as fiber optic cabling, optical guides, and the like. In FIGS. 1 and 2, this optical conduit means comprises a fiber optic cable 30 extending from each slave ICM to each of its associated ordnance devices. Slave ICMs 20-A and 22-A receive the state commands from master ICM 16-A, and re-transmits these state commands to their respective associated ordnance devices. Similarly, for channel B, ICMs 20-B and 22-B receive the state commands from master ICM 16-B, and re-transmits these state commands to their respective associated ordnance devices.

Coupling and communication between the master ICMs and the slave ICMs need not necessarily be via optical means, and may, for example, be electrical. If optical communication is used, master ICMs 16-A and 16-B will require appropriate electrical-to-optical conversion, and the slave ICMs will require appropriate optical-to-electrical conversion.

In the system according to this aspect of the invention, an ordnance device interface is used to manage the conversion of the incoming optical signals from the slave ICMs to the electrical inputs of the ordnance devices. The ordnance device interface accordingly preferably comprises an optical-to-electrical converter, for example, such as those of known design and commercially available.

It is desirable in some applications for part or all of the energy or power used to initiate the ordnance device to be provided with the corresponding state command, e.g., the fire command. This offers the potential advantage of reducing the amount of conduit, cabling, associated hardware, etc., required by the system.

Accordingly, in system 10, the signal communicated from controller 14 to the ordnance devices and including the state commands also comprises a power signal. The energy embodied in the signal, independently of the specific information content, is used to provide energy for causing the initiation of the ordnance devices. This can be accomplished, for example, by converting the optical signal received at the ordnance device interface from the slave ICMs into electrical energy, and using that electrical energy to power the initiator in the ordnance device. The signal may comprise the one embodying or communicating the state commands, but need not. Because in many applications the energy content, or energy density of the optical signal received at the ordnance device interface is insufficient to power the initiator directly, a capacitive device, such as a capacitor or capacitive network, can be used to accumulate the charge, and the capacitive device then can be selectively discharged into to initiator to provide the necessary power levels.

The specific location or locations and configuration of this capacitive device, and accordingly the specific location or locations of the ordnance device interface, are subject to some flexibility and adaptability to the particular application. A capacitive network, for example, may be positioned potentially at any location between the slave ICM and the initiator of the ordnance device. Moreover, a single capacitive network may by used to power a group of ordnance devices as a set, e.g., simultaneously. Preferably, however, a single capacitive device is used at or adjacent to each of the ordnance devices.

As implemented in system 100, each of the optical conduits 30 from the slave ICMs is inputted into an ordnance device interface module 32. In these embodiments, there actually are two such modules 32 for redundancy and system reliability. Each interface module 32 comprises an optical-to-digital converter 34 of known design and commercially available as noted above, with an optical input 35 and an electrical output 36. Output 36 is coupled via a diode device 38 to a capacitor 40, and to a switching device 42 responsive to the state command embodiment within the signal. Switching device 42 may take a number of forms, e.g., such as a programmable logic controller, a gate array, or other known switching device. The output of capacitor 40 is coupled to the input 44 of the switched conduction path of switching device 42. The output 46 of the switched conduction path is coupled to the initiator 48 of the individual ordnance device 12-n. As the optical signal embodying the state command is inputted to converter 32 and while switching device 42 is in the open state, the charge from output 36 is accumulated on capacitor 40. When sufficient charge has been accumulated on capacitor 40, and provided switching device 42 has received a valid "fire" state command, the conduction path is closed so that the energy in capacitor 40 is discharged to initiator 48. This causes initiator 48 to energize and initiate ordnance device 12-n.

It has been noted herein that there is flexibility regarding the specific manner in which the ordnance devices are positioned, grouped, initiated, etc. It is possible within the scope of the invention for the system and method to be configured or used such that the state command, or state commands, may be issued to individual ones of the ordnance devices, simultaneously, in patterns, according to a predetermined timing or sequence, etc., the ordnance devices may be grouped into sets and the individual sets treated separately, etc., or all of the ordnance devices may be operated as a single unified group. In all but the latter case, control and initiation of the ordnance devices may be accomplished by configuring the state command or commands to comprise addressing, e.g., for the individual ordnance devices, the segregated groups, etc. Accordingly, the state command or commands may comprise an ordnance device address for addressing individual ones of the ordnance device sets, they may address individual ones of the ordnance devices within one of the ordnance device sets, they may address individual ones of the ordnance devices, etc.

It is often desirable not only to issue state commands to the ordnance devices, but also to obtain information from the ordnance devices, or from the system, vehicle, device, etc. with which the ordnance control and initiation system is used. An example might involve collecting telemetry data from a flight vehicle in which the ordnance control and initiation system is being used. In such instances, a monitoring device, which may comprise any monitoring or measure device, such as a pressure transducer, a strain gauge, an electrical transducer, etc., may be optically coupled to one of the slave ignition control modules for generating an upstream signal embodying information from the measuring device output. This may be implemented, for example, by substituting the monitoring device for one of the ordnance devices 12-n, e.g., as shown in FIGS. 1 and 2.

The one of the slave ICMs then would comprise a transmitting device for re-transmitting the upstream signal to the master ignition control module; and the master control module would comprise a transmitting device for re-transmitting the upstream signal to the controller. These transmitting devices preferably comprise the known bi-directional communication modes and related hardware for communicating information upstream from the devices 12-n to controllers 14-A and 14-B.

Figure 5:
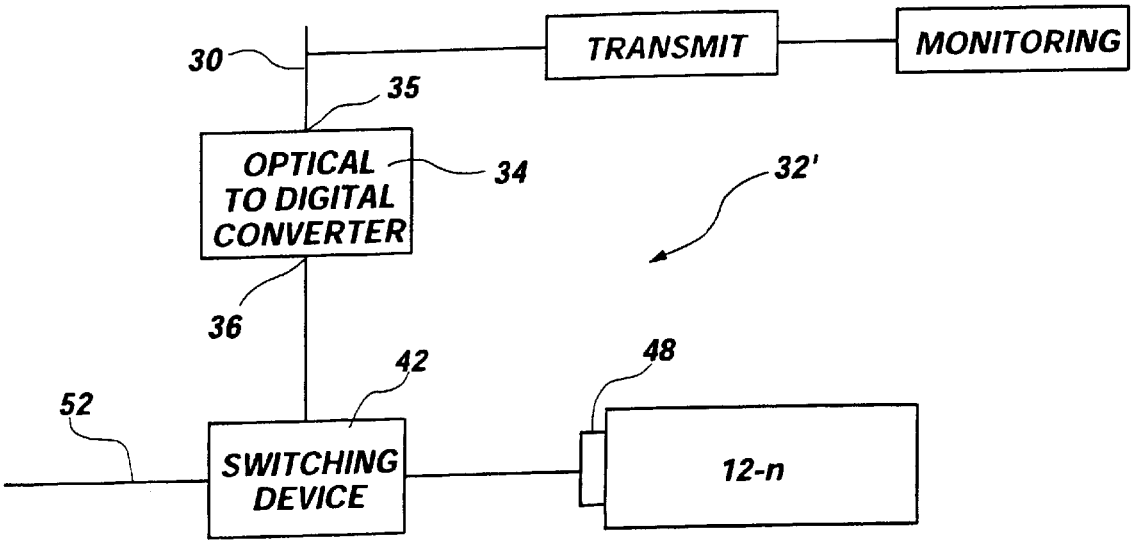
FIG. 5 is a schematic diagram of an ordnance device interface for the system of FIG. 1.
Figure 4:
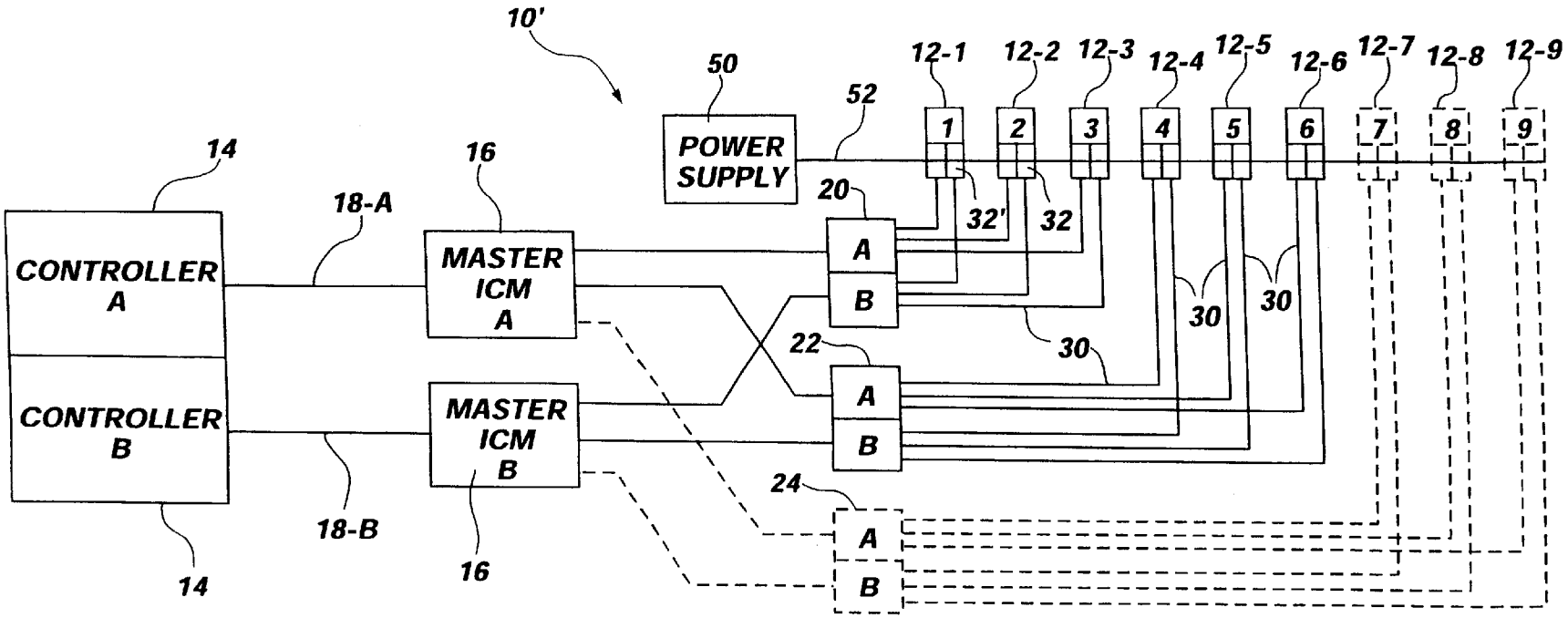
FIG. 4 is a schematic diagram of an ordnance control and initiation system according to a second presently preferred embodiment of the invention.

It is not necessary in every instance for the initiators of the ordnance devices to be powered by the signals from the slave ICMs as has been described above. It is possible to use the signal from the slave ICMs and the embodied state command to function as a switching or gating signal, and for a power supply, such as a switched power bus to be used to supply switched power to the ordnance devices. An example of this is illustrated in FIG. 4. FIG. 4 is largely identical to FIG. 2 and includes the same components except as noted here. The system of FIG. 4 includes a power supply 50 and power bus 52 for providing appropriate power to activate the initiators in the individual ordnance devices 12-n. Instead of interface 32, however, each ordnance device includes dual redundant switching modules 32' (FIG. 5), which comprise switching devices such as, e.g., devices 42, that are coupled to and responsive to the state commands received from the associated slave ICMs via optical conduits 30 and converter 34. Diode device 38 and capacitor 40 may be omitted. Power bus 52 is operatively coupled to the input conduction path 44 of switching devices 42 and the output 46 of the conduction path is coupled to initiator 48 so that, when a valid "fire" state command has been received at switching device 42, the conduction path is closed and the power from bus 52 is applied to initiator 48, thereby activating the initiator and the ordnance device.

The system according to the invention may be configured with a single channel, e.g., only channel A, as a dual channel A and B device (as shown in FIGS. 2 and 4), e.g., for redundancy, or as a multi-channel system having more than two channels. The system also may be expanded or scaled to accommodate more ordnance devices, and monitoring devices if desired, or the groupings may be changed or enlarged, for example, by adding additional slave ICMs.

In accordance with another aspect of the invention, an ordnance control and initiation system is provided for controlling and initiating a plurality of ordnance devices comprising a plurality of sets of the ordnance devices, wherein each set of the ordnance devices comprising at least one of the ordnance devices. This system is as described above, but differs in that it does not include, as part of the system the ordnance devices themselves. The components, preferred embodiments, and other aspects of the system are as described above, but wherein the ordnance devices, including the initiators, are deemed part of the environment in which the system operates, but are not technically deemed a part of the system.

In accordance with yet another aspect of the invention, a method is provided for controlling and selectively initiating ordnance devices. The method according to this aspect of the invention may be implemented using the preferred system embodiments according to the invention as described herein above, but is not necessarily limited to these systems and embodiments. To illustrate the method and its principles, however, a presently preferred version or implementation of the method will now be described with reference to the presently preferred system embodiments according to the invention.

The method according to this aspect of the invention comprises communicating state commands from a controller to a master ignition control module operatively coupled to the controller. As implemented in the preferred method, this comprises communicating state commands, e.g., the safe, arm, and fire state commands, from controller 14 (14-A and 14-B) to master ICM 16 (16-A and 16-B, respectively).

The method also comprises communicating the state commands from the master ignition control module to a plurality of slave ignition control modules operatively coupled to the master ignition control module, wherein each of the slave ignition control modules is associated with one of a plurality of sets of ordnance devices and is optically coupled to an ordnance device interface of the one of the ordnance device sets of that slave ignition control module. In the preferred method, this may be implemented by communicating the state commands from master ICM 16 to the slave ICMs, e.g., 20-A and B, 22-A and B. . . .

The method further comprises communicating the state commands from each of the slave ignition control modules to the ordnance devices of the one of the ordnance device sets of that slave ignition control module. In the preferred method, this may be implemented by optically communicating the state commands from the slave ICMs to the ordnance devices 12-n, e.g., as grouped and configured in FIGS. 2 and 4.

The preferred method comprises optically communicating an upstream signal from a monitoring device optically coupled to one of the slave ignition control modules to the one of the slave control modules, communicating the upstream signal from the one of the slave ignition control modules to the master ignition control module, and communicating the upstream signal from the master ignition control signal to a controller. These aspects of the preferred method are implemented by using monitoring devices, such as those described above, to communicate the measurement data from the monitoring devices via slave ICMs and master ICMs to the controller, as described above.

Additional advantages and modifications will readily occur to those skilled in the art. Therefore, the invention in its broader aspects is not limited to the specific details, representative devices and methods, and illustrative examples shown and described. Accordingly, departures may be made from such details without departing from the spirit or scope of the general inventive concept as defined by the appended claims and their equivalents.

What is claimed is:

1. An ordnance control and initiation system comprising:

a plurality of ordnance devices comprising a plurality of sets of the ordnance devices, each set of the ordnance devices comprising at least one of the ordnance devices and an ordnance device interface;

a controller for issuing state commands;

a master ignition control module operatively coupled to the controller to receive the state commands and re-transmit the state commands;

a plurality of slave ignition control modules, each of the slave ignition control modules being associated with one of the sets of the ordnance devices and being operatively coupled to the master ignition control module and optically coupled to the ordnance device interface of the one of the ordnance device sets of that slave ignition control module, each of the slave ignition control modules configured for receiving the state commands and re-transmitting the state commands to the ordnance devices of the one of the ordnance device sets of that slave ignition control module.

2. The ordnance control and initiation system as recited in claim 1, wherein the ordnance device interface of one of the ordnance device sets comprises an optical-to-electrical converter.

3. The ordnance control and initiation system as recited in claim 2, wherein each of the ordnance devices of the one of the ordnance device sets comprises a capacitor device operatively coupled to the optical-to-electrical converter so that the capacitor device is charged when light from the slave ignition control module corresponding to that ordnance device set impinges upon the optical-to-electrical converter.

4. The ordnance control and initiation system as recited in claim 3, wherein each of the ordnance devices comprises an initiator operatively coupled to the capacitor device to receive electrical energy from the capacitor device when the capacitor device is discharged.

5. The ordnance control and initiation system as recited in claim 1, wherein:

one of the ordnance device sets comprises a plurality of the ordnance devices;

each of the ordnance devices of the one ordnance device set comprises an initiator; and the ordnance device interface of the one of the ordnance device sets comprises a plurality of optical-to-electrical converters corresponding in number to the number of ordnance devices of the one ordnance device set, each of the ordnance devices of the one of the ordnance device sets having an associated one of the optical-to-electrical converters.

6. The ordnance control and initiation system as recited in claim 5, wherein each of the ordnance devices of the one of the ordnance device sets comprises a capacitor device operatively coupled to the associated optical-to-electrical converter so that the capacitor device is charged when light from the slave ignition control module corresponding to that ordnance device impinges upon the associated optical-to-electrical converter.

7. The ordnance control and initiation system as recited in claim 1, wherein each of the ordnance devices comprises a semiconductor bridge initiator.

8. The ordnance control and initiation system as recited in claim 7, wherein the semiconductor bridge initiator comprises titanium subhydride potassium perchlorate.

9. The ordnance control and initiation system as recited in claim 1, wherein each of the ordnance devices comprises a thin film bridge initiator.

10. The ordnance control and initiation system as recited in claim 1, wherein the state commands comprise a safe command.

11. The ordnance control and initiation system as recited in claim 1, wherein the state commands comprise an arm command.

12. The ordnance control and initiation system as recited in claim 1, wherein the state commands comprise a fire command.

13. The ordnance control and initiation system as recited in claim 1, wherein the state commands comprise a power signal.

14. The ordnance control and initiation system as recited in claim 1, wherein the state commands comprise an ordnance device address for addressing individual ones of the ordnance device sets.

15. The ordnance control and initiation system as recited in claim 1, wherein the state commands comprise an ordnance device address for addressing individual ones of the ordnance devices within one of the ordnance device sets.

16. The ordnance control and initiation system as recited in claim 1, wherein the state commands comprise an ordnance device address for addressing individual ones of the ordnance devices.

17. The ordnance control and initiation system as recited in claim 1, wherein the master ignition control module is optically coupled to the slave ignition control modules.

18. The ordnance control and initiation system as recited in claim 1, wherein the master ignition control module is electrically coupled to the slave ignition control modules.

19. The ordnance control and initiation system as recited in claim 1, further including: a monitoring device optically coupled to one of the slave ignition control modules for generating an upstream signal;

the one of the slave control modules comprises a transmitting device for re-transmitting the upstream signal to the master ignition control module; and the master ignition control module comprises a transmitting device for re-transmitting the upstream signal to the controller.

20. An ordnance control and initiation system comprising:

a plurality of ordnance devices comprising a first and a second plurality of sets of the ordnance devices, each set of the ordnance devices comprising at least one of the ordnance devices and an ordnance device interface;

a controller for issuing state commands;

first and second master ignition control modules operatively coupled to the controller to receive the state commands and re-transmit the state commands;

a first and a second plurality of slave ignition control modules, each of the slave ignition control modules of the first plurality of slave ignition control modules being associated with one of the first plurality of sets of the ordnance devices and each of the slave ignition control modules of the second plurality of slave ignition control modules being associated with one of the second plurality of sets of the ordnance devices, each of the slave ignition control modules being operatively coupled to the master ignition control module and optically coupled to the ordnance device interface of the one of the ordnance device sets of that slave ignition control module, each of the slave ignition control modules configured for receiving the state commands and re-transmitting the state commands to the ordnance devices of the one of the ordnance device sets of that slave ignition control module.

21. An ordnance control and initiation system for controlling and initiating a plurality of ordnance devices comprising a plurality of sets of the ordnance devices, each set of the ordnance devices comprising at least one of the ordnance devices; the system comprising:

a plurality of ordnance device interfaces corresponding in number to the number of ordnance device sets, each of the ordnance device interfaces having a corresponding one of the ordnance device sets;

a controller for issuing state commands;

a master ignition control module operatively coupled to the controller to receive the state commands and re-transmit the state commands; and a plurality of slave ignition control modules, each of the slave ignition control modules being associated with one of the sets of the ordnance devices and being operatively coupled to the master ignition control module and optically coupled to the ordnance device interface of the one of the ordnance device sets of that slave ignition control module, each of the slave ignition control modules configured for receiving the state commands and re-transmitting the state commands to the ordnance devices of the one of the ordnance device sets of that slave ignition control module.

22. The ordnance control and initiation system as recited in claim 21, wherein the ordnance device interface corresponding to one of the ordnance device sets comprises an optical-to-electrical converter.

23. The ordnance control and initiation system as recited in claim 22, wherein each of the ordnance device interfaces comprises a capacitor device operatively coupled to the optical-to-electrical converter so that the capacitor device is charged when light from the slave ignition control module corresponding to that ordnance device set impinges upon the optical-to-electrical converter.

24. The ordnance control and initiation system as recited in claim 23, wherein each of the ordnance devices comprises an initiator and the capacitor device includes coupling means for coupling the capacitor device to the initiator so that the capacitor device discharges into the initiator.

25. The ordnance control and initiation system as recited in claim 21, wherein:

one of the ordnance device sets comprises a plurality of the ordnance devices;

each of the ordnance devices of the one ordnance device set comprises an initiator; and.

the ordnance device interface corresponding to the one of the ordnance device sets comprises a plurality of optical-to-electrical converters corresponding in number to the number of ordnance devices of the one ordnance device set, each of the optical-to-electrical converters being associated with one of the ordnance devices of the one of the ordnance device sets.

26. The ordnance control and initiation system as recited in claim 25, wherein each of the ordnance device interfaces comprises a capacitor device operatively coupled to the associated optical-to-electrical converter so that the capacitor device is charged when light from the slave ignition control module corresponding to that ordnance device impinges upon the associated optical-to-electrical converter.

27. The ordnance control and initiation system as recited in claim 21, wherein each of the ordnance devices comprises a semiconductor bridge initiator.

28. The ordnance control and initiation system as recited in claim 21, wherein each of the ordnance devices comprises a thin film bridge initiator.

29. The ordnance control and initiation system as recited in claim 21, wherein the state commands comprise a safe command.

30. The ordnance control and initiation system as recited in claim 21, wherein the state commands comprise an arm command.

31. The ordnance control and initiation system as recited in claim 21, wherein the state commands comprise a fire command.

32. The ordnance control and initiation system as recited in claim 21, wherein the state commands comprise a power signal.

33. The ordnance control and initiation system as recited in claim 21, wherein the state commands comprise an ordnance device address for addressing individual ones of the ordnance device sets.

34. The ordnance control and initiation system as recited in claim 21, wherein the state commands comprise an ordnance device address for addressing individual ones of the ordnance devices within one of the ordnance device sets.

35. The ordnance control and initiation system as recited in claim 21, wherein the state commands comprise an ordnance device address for addressing individual ones of the ordnance devices.

36. The ordnance control and initiation system as recited in claim 21, wherein the master ignition control module is optically coupled to the slave ignition control modules.

37. The ordnance control and initiation system as recited in claim 21, wherein the master ignition control module is electrically coupled to the slave ignition control modules.

38. The ordnance control and initiation system as recited in claim 21, further including: a monitoring device optically coupled to one of the slave ignition control modules for generating an upstream signal;

the one of the slave ignition control modules comprises a transmitting device for re-transmitting the upstream signal to the master ignition control module; and the master ignition control module comprises a transmitting device for re-transmitting the upstream signal to the controller.

39. An ordnance control and initiation system for controlling and initiating a plurality of ordnance devices comprising a first and a second plurality of sets of the ordnance devices, each set of the ordnance devices comprising at least one of the ordnance devices, the system comprising:

a plurality of ordnance device interfaces corresponding in number to the number of ordnance device sets, each of the ordnance device interfaces having a corresponding one of the ordnance device sets;

a controller for issuing state commands;

first and second master ignition control modules operatively coupled to the controller to receive the state commands and re-transmit the state commands;

a first and a second plurality of slave ignition control modules, each of the slave ignition control modules of the first plurality of slave ignition control modules being associated with one of the first plurality of sets of the ordnance devices and each of the slave ignition control modules of the second plurality of slave ignition control modules being associated with one of the second plurality of sets of the ordnance devices, each of the slave ignition control modules being operatively coupled to the master ignition control module and optically coupled to the ordnance device interface of the one of the ordnance device sets of that slave ignition control module, each of the slave ignition control modules configured for receiving the state commands and re-transmitting the state commands to the ordnance devices of the one of the ordnance device sets of that slave ignition control module.

40. A method for controlling and selectively initiating ordnance devices, the method comprising:

communicating state commands from a controller to a master ignition control module operatively coupled to the controller;

communicating the state commands from the master ignition control module to a plurality of slave ignition control modules operatively coupled to the master ignition control module, each of the slave ignition control modules being associated with one of a plurality of sets of ordnance devices and being optically coupled to an ordnance device interface of the one of the ordnance device sets of that slave ignition control module; and communicating the state commands from each of the slave ignition control modules to the ordnance devices of the one of the ordnance device sets of that slave ignition control module.

41. The method as recited in claim 40, wherein the communication from the slave ignition control modules to the ordnance devices comprises performing an optical-to-electrical conversion of the state commands.

42. The method as recited in claim 41, wherein the optical-to-electrical conversion comprises charging a capacitor device and selectively discharging the capacitor device into an initiator for each of the ordnance devices.

43. The method as recited in claim 40, wherein the state commands comprise a safe command.

44. The method as recited in claim 40, wherein the state commands comprise an arm command.

45. The method as recited in claim 40, wherein the state commands comprise a fire command.

46. The method as recited in claim 40, wherein the state commands comprise a power signal.

47. The method as recited in claim 40, wherein the state commands comprise an ordnance device address for addressing individual ones of the ordnance device sets.

48. The ordnance control and initiation system as recited in claim 40, wherein the state commands comprise an ordnance device address for addressing individual ones of the ordnance devices within one of the ordnance device sets.

49. The method as recited in claim 40, wherein the state commands comprise an ordnance device address for addressing individual ones of the ordnance devices.

50. The method as recited in claim 40, wherein the communication of the state commands from the master ignition control module to the slave ignition control modules is optical.

51. The method as recited in claim 40, wherein the communication of the state commands from the master ignition control module to the slave ignition control modules is electrical.

52. The method as recited in claim 40, further including:

optically communicating an upstream signal from a monitoring device optically coupled to one of the slave ignition control modules;

communicating the upstream signal from the one of the slave ignition control modules to the master ignition control module; and communicating the upstream signal from the master ignition control module to the controller.

* * * * *

UNITED STATES PATENT AND TRADEMARK OFFICE

CERTIFICATE OF CORRECTION

PATENT NO. : 6,718,881 B2 
DATED : April 13, 2004
INVENTOR(S) : Robert A. Rauscher, Jr.

It is certified that error appears in the above-identified patent and that said Letters Patent is hereby corrected as shown below:

Title page,
Item [56], References Cited, U.S. PATENT DOCUMENTS, before "4/1993" delete "*"; before "4/1995" delete "*"; before "3/2001" delete "*"
Item [57], ABSTRACT,
Line 8, change "retransmits" to -- re-transmits --

Column 1,
Line 14, change "Description" to -- State -- and delete "Related"

Column 2,
Line 47, delete " optical"
Line 48, delete "transmission."
Line 53, change "OBJECTS" to -- BRIEF SUMMARY --
Line 55, change "Accordingly, an object of the" to -- The -- and change "is" to -- provides --
Line 57, change "reliable" to -- of enhanced reliability -- and change "methods, and thus" to -- methods and, thus, --
Line 59, change "It is another object of the" to -- The present -- and change "to provide" to -- also provides --
Line 63, change "It is also an object of the" to -- The present -- and change "to provide" to -- further provides --
Lines 66-67, delete the lines in their entirety Column 3,
Lines 1-7, delete the lines in their entirety
Line 9, change "To achieve the foregoing objects, and in" to -- In --
Line 10, change "purposes of the" to -- present --
Line 12, change "It" to -- The system --
Line 26, change "retransmits" to -- re-transmits --
Line 36, change "optical to electrical" to -- optical-to-electrical --
Line 63, change "application," to -- applications --

Column 4,
Line 5, change "preferably is" to -- is preferably --

Column 5,
Line 10, change "optical to electrical" to -- optical-to-electrical --
Line 31, start a new paragraph with the sentence beginning with "In accordance,"
Line 63, after "devices" and before the period insert -- is provided --

Column 6,
Line 25, delete "state from of the"
Line 60, change "PREFERRED" to -- EXEMPLARY -- and delete "AND METHODS"

UNITED STATES PATENT AND TRADEMARK OFFICE

CERTIFICATE OF CORRECTION

PATENT NO. : 6,718,881 B2
DATED : April 13, 2004
INVENTOR(S) : Robert A. Rauscher, Jr.

It is certified that error appears in the above-identified patent and that said Letters Patent is hereby corrected as shown below:

Column 8,
Line 41, change "20B" to -- 20-B --
Line 42, change "22-B" to -- 24-B --
Line 54, after "redundantly" and before "control" insert -- to --

Column 9,
Line 42, before "initiator" change "to" to -- an --
Line 55, change "100," to -- 10, --
Line 55, delete "optical"
Line 56, change "conduits" to -- fiber optic cables --

Column 10,
Line 6, change "32" to -- 34 --
Line 58, change "controllers " to -- C&DH systems --

Column 11,
Line 1, after "system" and before "of" insert -- 10' --
Line 8, change "optical conduits" to -- fiber optic cables --
Line 10, delete "conduction path"
Line 54, change "(14-A" to -- (systems 14-A --
Line 55, change "(16-A" to -- (units 16-A --
Line 67, after last period delete -- ... --

Column 15,
Line 6, delete the period after "and"

Signed and Sealed this

Twenty-eighth Day of December, 2004

JON W. DUDAS
*Director of the United States Patent and Trademark Office*